United States Patent [19]

Stevens

[11] 4,290,354

[45] Sep. 22, 1981

[54] BEVERAGE CAN CRUSHER

[76] Inventor: Benjamin A. Stevens, 141 Apple Dr., Greencastle, Pa. 17225

[21] Appl. No.: 141,621

[22] Filed: Apr. 18, 1980

[51] Int. Cl.[3] ..... B30B 15/32

[52] U.S. Cl. ..... 100/218; 100/266; 100/283; 100/293; 100/295

[58] Field of Search ..... 100/DIG. 2, 218, 53, 100/266, 293, 283, 295; 241/99; 99/581, 582, 583

[56] References Cited

U.S. PATENT DOCUMENTS

| | | | |
|---|---|---|---|
| 1,044,448 | 11/1912 | Flis | 99/582 |
| 2,563,379 | 8/1951 | Smith | 100/DIG. 2 |
| 2,703,522 | 3/1955 | Smith | 100/283 |
| 3,009,414 | 11/1961 | Griemert | 100/DIG. 2 |
| 3,772,984 | 11/1973 | Karls | 100/295 X |
| 4,062,283 | 12/1977 | Kaminski | 100/DIG. 2 |

FOREIGN PATENT DOCUMENTS

| | | | |
|---|---|---|---|
| 1394107 | 2/1965 | France | 100/DIG. 2 |
| 1156139 | 6/1969 | United Kingdom | 100/DIG. 2 |

*Primary Examiner*—Billy J. Wilhite

*Attorney, Agent, or Firm*—Oblon, Fisher, Spivak, McClelland & Maier

[57] ABSTRACT

A crusher assembly which includes a base having a first and second shelf portion extending therefrom, at least one guide rod interconnecting the upper and lower shelf portion, a presser member slidably mounted on the at least one guide rod for movement between a first open position for receiving an object to be crushed and a second compression position, a pin member connected to the presser member, a handle member, a pivot member pivotably connecting the handle member to the first shelf portion, a link member pivotably connecting the handle member and the pin member, the link member being interconnected to the handle member in the open position above the pivot member wherein the pivot member, the at least one guide rod, the handle member and the pin member are disposed in substantially the same plane in the open position for maximizing the crushing force applied to the object to be crushed positioned between the presser member and the at least one of the first and second shelf portions.

9 Claims, 11 Drawing Figures

BEVERAGE CAN CRUSHER

BACKGROUND OF THE INVENTION

1. Field of the Invention

The present invention is directed to a crusher assembly and, more particularly, to a manually operated can crusher for compressing cans and similar objects made of aluminum, steel, etc. such as are used for packaging various beverages.

2. Description of the Prior Art

It has been recognized that recycling aluminum cans and other objects made of other recyclable material would be easier and more economical if they were first crushed. Accordingly, it is felt that a single, easily used can crusher positioned on vending machines, for example, could encourage such recycling and take much less space for storage of cans not to mention the enormeous energy savings.

Aluminum has been determined to be a preferable recyclable material because it requires only 5% of the energy to recycle aluminum to make it from bauxite ore. It has been determined that there were approximately 1.35 billion pounds of aluminum used in beverage cans in 1978 and thus, the possibility of energy savings resulting from their recycling is considered to be enormous. As an example, Reynolds Aluminum recycling centers, of which there are presently 994 throughout the United States, are paying 23 cents per pound for used aluminum beverage cans and, if all cans were recyclable aluminum, it is estimated that U.S. citizens could save $312.7 million dollars a year.

It has also been recognized that there is another advantage in having a market acceptable beverage can crusher in that a reduction of volume or space required to store used beverage cans results therefrom. As an example, if in 1978, 59% of the 53 billion beverage used were aluminum, the other 41% constituted another material with the material being the most used besides aluminum consisting of tin plated steel. Therefore, it can be expected that in order to be acceptable to the market, a beverage can crusher should be capable of crushing any beverage can, aluminum or steel. Although the recyclable value of aluminum is greatest, steel is also recyclable and could thus be valuable. It is also to be noted that tremendous savings from the can crusher is derived from trash hauling cost since by crushing the cans and storing the same in containers up to 60% can be saved in trash disposal costs.

Although a number of attempts have been made to produce a market acceptable beverage can crusher and numerous patents have been issued for various can crushers, such have not gained wide spread use. In this regard, it should be noted that can crushers have heretofore suffered from the same drawbacks, i.e. lack of market acceptance. In this regard, it is felt that there are a number of reasons why, despite the obvious advantages and potential energy savings, such have not been accepted in the market.

In determining the reasons for this lack of market acceptance, it is first necessary to analyze the beverage can itself, the previous art in can crusher design and to evaluate marketing acceptance. First of all, with regard to the beverage can, its dimensions, composition, number, condition and strength must be determined. For example, the structural strength, that is, the ability to carry a dead load structurally of beverage cans is to be considered. An all aluminum can will support 210 pounds before collapsing, a one-piece tin plated steel can can support 335 pounds before collapsing and a seamed steel can will support 645 pounds before collapsing. Therefore a successful beverage can crusher must be capable of producing initial crushing force of more than 645 pounds.

To gain wide spread use and to be acceptable in the market, a can crusher must also be inexpensive and therefore should be manually operated. Even so, it is recognized that the present invention is capable of being adaptable to automatic machines. A study was made to determine how much human manual effort is considered acceptable or desirable with a result that a 30 pound to 50 pound push and pull was considered to be the maximum a person would find acceptable. The beverage can crusher of the present invention was therefore designed to produce a force curve that matches almost identically the force curve necessary to crush a beverage can or similar object and stay within the acceptable limits of human effort in so doing.

An actual testing of the beverage can crusher of the present invention, 50 pounds was the maximum force input required to fully crush a seamed steel beverage can whereas the force required to crush all aluminum beverage cans ranged from 5 pounds to 20 pounds. While the previous art in beverage can crushers recognized the strength of beverage cans, such did not effectively multiple their input force to overcome the initial collapse strength. Therefore, the actuating handle or lever on can crushers of the prior art were necessarily extremely long in order to gain the leverage necessary to create an initial collapse of the can. On the other hand, the can crusher of the present invention produces an infinite force multiplication at both extremes of its travel (i.e. at the top where the can is its strongest and again at the bottom when the can is fully crushed). Furthermore, it is noted that the numerous shortcomings of the prior art were overcome by the can crusher of the present invention.

SUMMARY OF THE INVENTION

One object of the present invention is to provide a crusher assembly which produces an infinite force multiplication at both extremes of its travel (i.e. at the top or open position where the can or other object is its strongest and again at the bottom or compression position when the can or other object is fully crushed).

Another object of the present invention is to provide a crusher assembly which is simple in construction, which is low in cost and which can be easily installed on vending machines, etc. so as to facilitate recycling of the materials and the object to be crushed.

A further object of the present invention is to provide a quick and safe crusher assembly which is compact in size.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIG. 6A shows a force diagram explaining the operation of the present invention while

DETAILED DESCRIPTION OF THE PREFERRED EMBODIMENT

Figure 1:
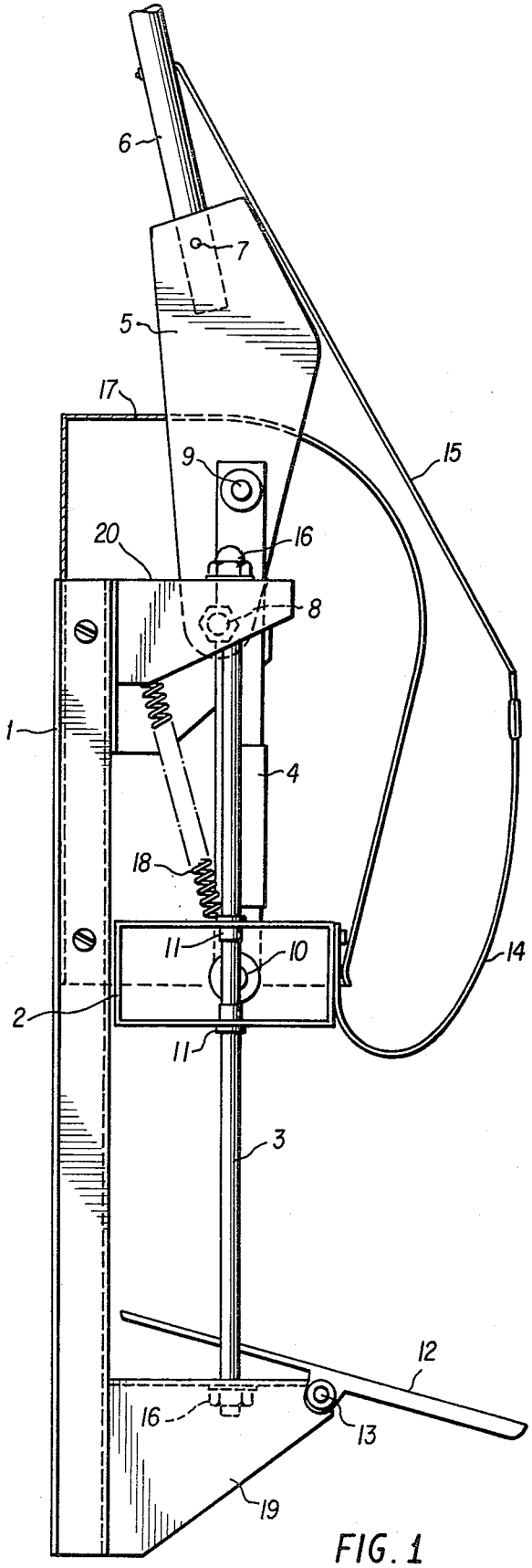
FIG. 1 is a side view of the present invention in the open position for receiving an object to be crushed.
Figure 2:
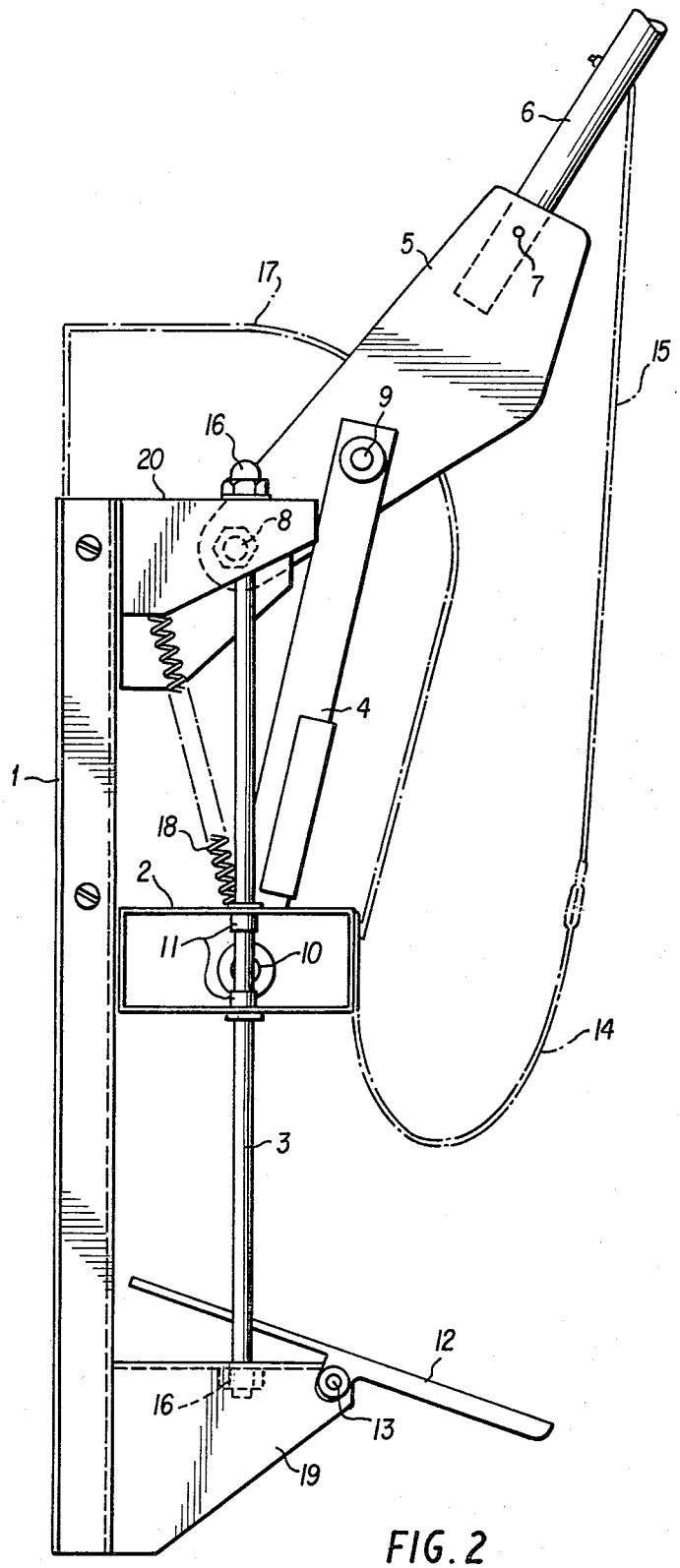
FIG. 2 is a side view of the present invention in the position where the object would be partially crushed.
Figure 3:
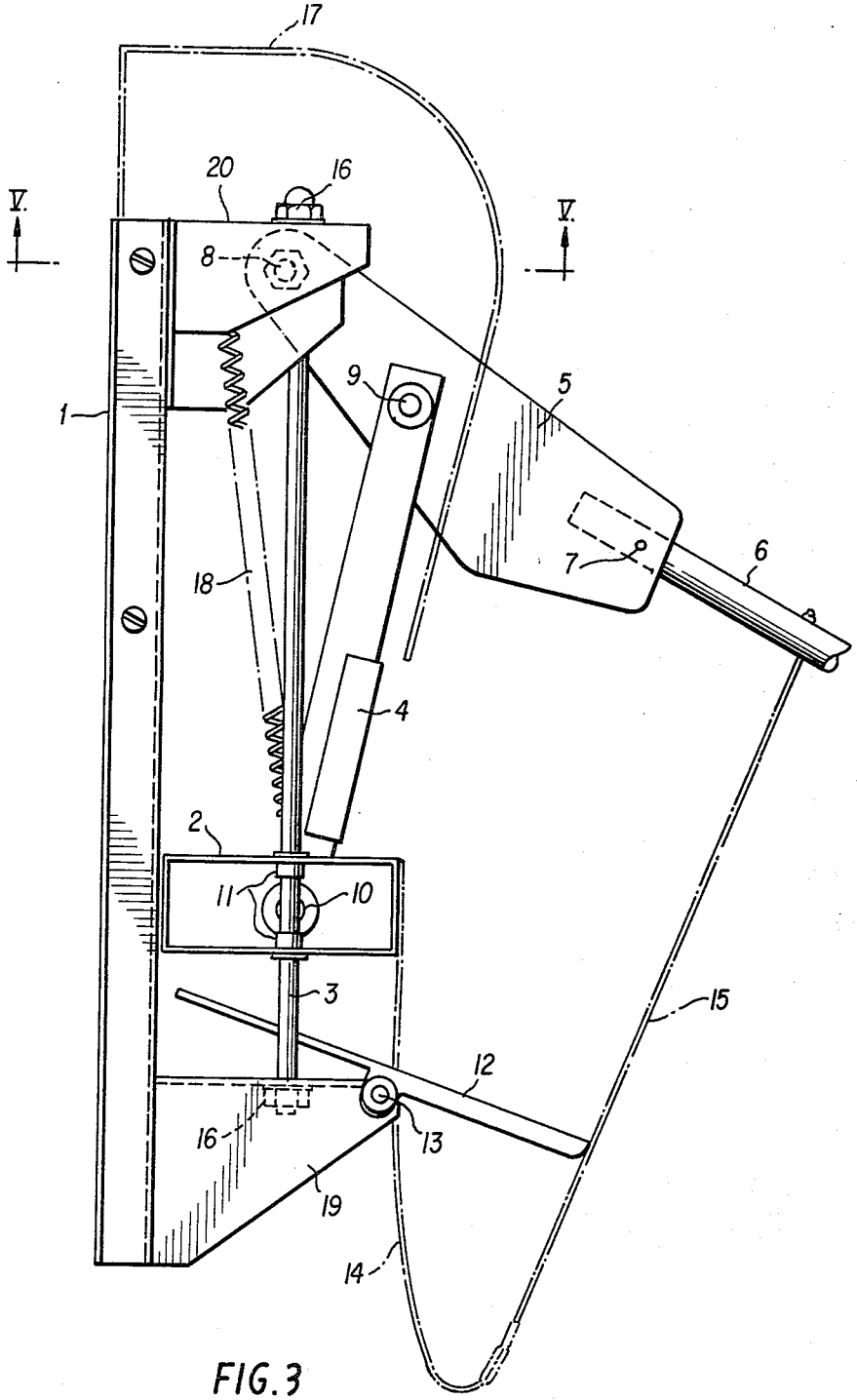
FIG. 3 is a side view of the present invention where the object would be completely crushed and ready for ejection.
Figure 4:
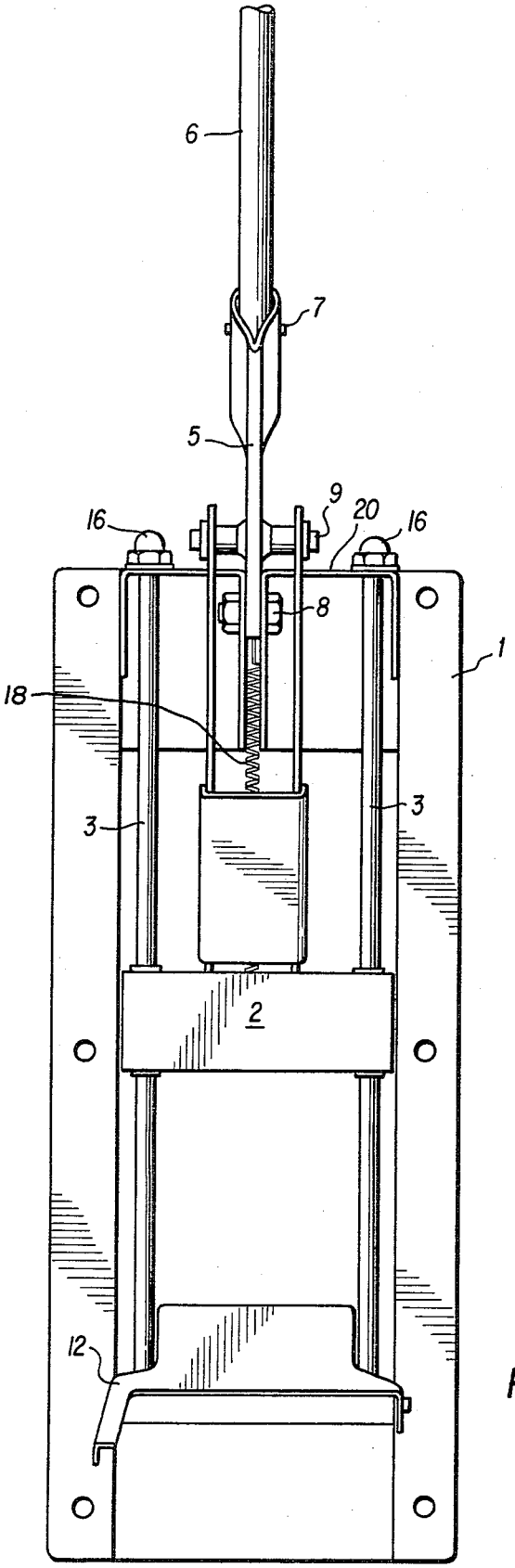
FIG. 4 is a front elevational view of the present invention.

FIGS. 1–4 serve to illustrate the beverage can crusher of the present invention which is designed to be vertically mounted on any surface but is particularly suited to be mounted on beverage vending machines. Such is thus compact in size and requires very little space for mounting. The operation of crushing beverage cans or similar objects is simple in that a can is merely inserted beneath the presser member and the handle lever is pulled through its full travel. After crushing, the handle is returned to the top position and the crushed can is ejected into a conventional container with the entire operation taking approximately 2 to 3 seconds.

The can crusher of the present invention includes a base 1 including a first lower and second upper shelf portion 19, 20 extending from the base. A pair of guide rods 3, 3 serve to interconnect the upper and lower shelf portions 20, 19 and a presser member 2 is slidably mounted on the guide rods 3, 3 for movement between a first open position for receiving a can or other object to be crushed therebelow (see FIG. 1) and a second compression position (see FIG. 3) wherein the can or other object has been crushed as necessary so as to be ready for ejection.

A pin member 10 is also connected to the presser member as illustrated. A handle-lever 6 is also pivotably connected to the upper shelf portion 20 via pivot member 8. A link member 4 serves to pivotably interconnect the handle member 6 and the pin member 10. The link member 4 is interconnected with the handle member 6 in the open position shown in FIG. 1 above pivot member 8 such that the pivot member 8, the guide rods 3, 3, the handle member 6 and the pin member 10 are disposed in substantially the same plane in the open position for maximizing the crushing force applied to the object to be crushed positioned between the presser member 2 and the lower shelf 19. The handle member 6 includes a handle portion 5 and a roll pin 7. The handle member is pivotable in a clockwise direction through an angle of approximately 120°.

The link assembly 4 is pivotally connected to handle 5 via a pin 9. A spring member 18 also serves to interconnect the upper shelf 20 with presser member 2 and serves to bias the presser member 2 in an upward direction for ease of insertion of the object to be crushed.

The presser member 2 also includes a pair of bushings 11,11 which may be made of plastic material for sliding engagement with guide rods 3, 3 for the upward and downward movement of the presser member 2. The guide rods 3, 3 are secured to the upper and lower shelf portions 19, 20 via cap nuts 16, 16.

The lower shelf portion 19 includes an ejector 12 pivotally mounted thereto by an ejector pivot pin 13.

The crusher assembly also includes a flap 14 secured to the presser member and a second spring member 15 which interconnects the flap 14 with the handle member 6. Moreover, a cover can be utilized for covering the link assembly 4, spring 18, etc.

It can thus be appreciated that in operation, in the starting position, the handle 5 and handle member 6 are overcenter such that the pivot member 8, the guide rods 3, the handle member 6 and the pin member 10 are disposed in substantially the same plane for maximizing the crushing force applied to the object to be crushed as will be described hereinbelow. The counter balance spring 18 attached to the pivot pin 10 of the presser member 2 assists in holding the presser member in its top position. As the handle 6 is pulled forward, spring 18 prevents the handle from accidentally falling and striking the operator.

When the handle 6 is in its topmost or upward position, spring 15 or a similar device attached to the handle 6 raises so as to correspondingly raise flap 14 so as to provide easy, unobstructed access for placement of a beverage can or other object between presser member 2 and lower shelf portion 20. As handle 6 is pulled forward (i.e. rotated in a clockwise direction as shown in FIGS. 1–4), flap 14 is lowered so as to cover the beverage can and prevent splashing upon the operator of any residue beverage in the can being crushed.

The beverage can is crushed by presser member 2 due to vertical downward movement of the same against the can upon being set on lower shelf portion 19. Clockwise rotary movement of handle 6 produces a downward vertical movement of the presser member 2 via link assembly 4. The vertical force applied is the vertical component of the vector link force applied to pin 10.

It can thus readily be seen that with a constant force input on handle 6, a power curve is generated that produces a maximum vertical force downward at the top and bottom of travel of presser member 2. The horizontal component of the vectored link force is least at the top and bottom of travel of presser member 2 and correspondingly greatest at the center of travel. This coincides with the force necessary to crush beverage cans and transmits the least amount of horizontal force into base 1. Moreover, the horizontal force is absorbed by the bearings 11 in the presser member 2 sliding on guide rods 3, 3. Guide rods 3, 3 serve to guide the presser member 2 and also provide supporting strength to the lower shelf portion 20 upon which the cans sit.

After the can is crushed and handle 6 is returned to its top position shown in FIG. 1, the crushed can is ejected into a container by pivoting the ejector handle 12 about the axis of ejector pivot pin 13. Since the beverage can is effectively crushed by the above-noted operation, it has been found that nearly every can can be cleanly ejected by the ejector 12.

Figure 5:
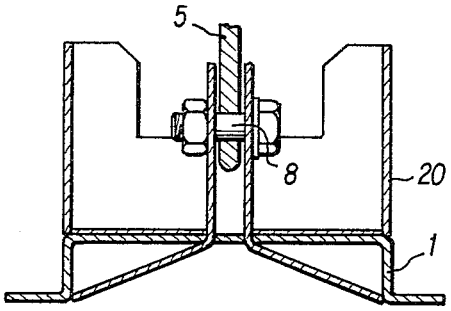
FIG. 5 is a view taken along line V—V in FIG. 3.

FIG. 5 serves to more clearly illustrate the detail of pivot bolt 8 in cooperation with handle 5 and upper shelf portion 20.

Figure 6A:
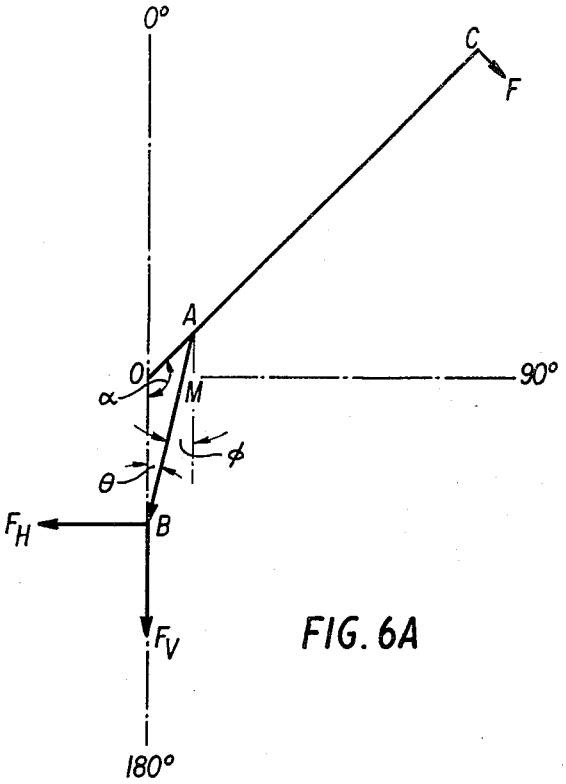
Figure 6B:
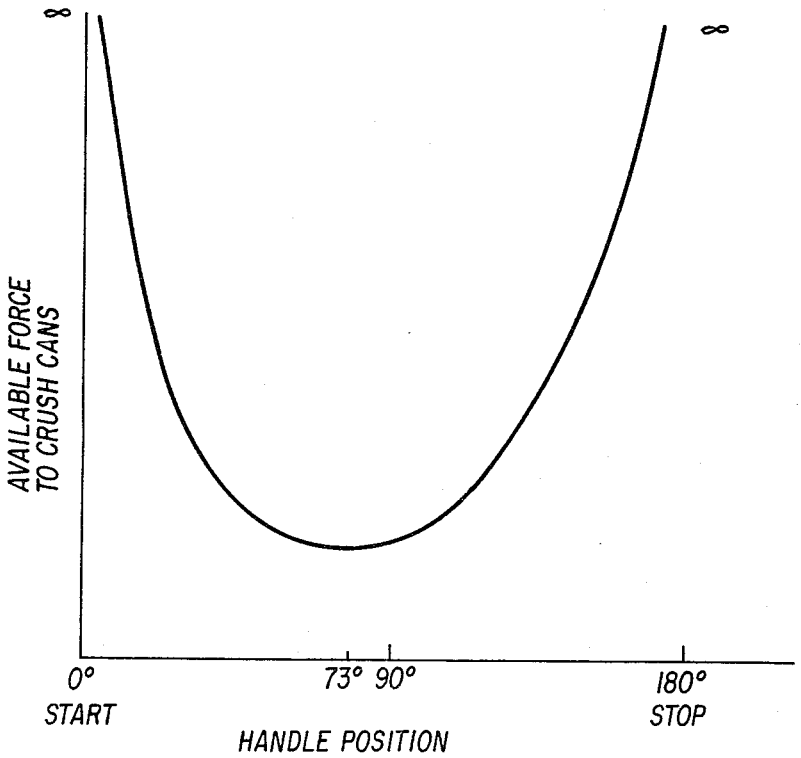
FIG. 6B illustrates the power curve of the present invention with a constant force input.

As shown in FIG. 6A, if a constant force F is exerted on handle OC at point C while point A revolves from 0° to 180°, a torque is produced at point O. The equivalent force in link AB can be found by calculating the perpendicular distance OM and dividing the torque at O by distance OM. Obviously, as point A approaches 0° or 180°, the length of OM approaches zero. The maximum length OM can ever be is thus equal to OA and thus, the least multiplication of power is when OM is its longest and the maximum multiplication of power is when OM is its shortest. The power curve in FIG. 6B graphically shows the force thus available to crush a beverage can.

EXAMPLE I

A test was conducted utilizing the present invention so as to determine the effort required to crush various cans. The equipment used included a tensionometer connected at the upper portion of the handle 6 so as to apply a pulling force at a 90° angle to the axis of handle 6. The handle 6 travelled through an arc of 180° in crushing the beverage cans and the tensionometer readings were obtained as the maximum reading present in four positions as set forth hereinbelow.

| Position | All Aluminum | 1 Piece Steel Can | Seamed Steel |
|---|---|---|---|
| 0°–45° | 5–8 lbs | 32 lbs | 35 lbs |
| 45°–90° | 5–9 lbs | 10–16 lbs | 20 lbs |
| 90°–135° | 10–15 lbs | 10–16 lbs | 25–40 lbs |
| 135°–180° | 10–20 lbs | 20–30 lbs | 45–50 lbs |

Figure 7:
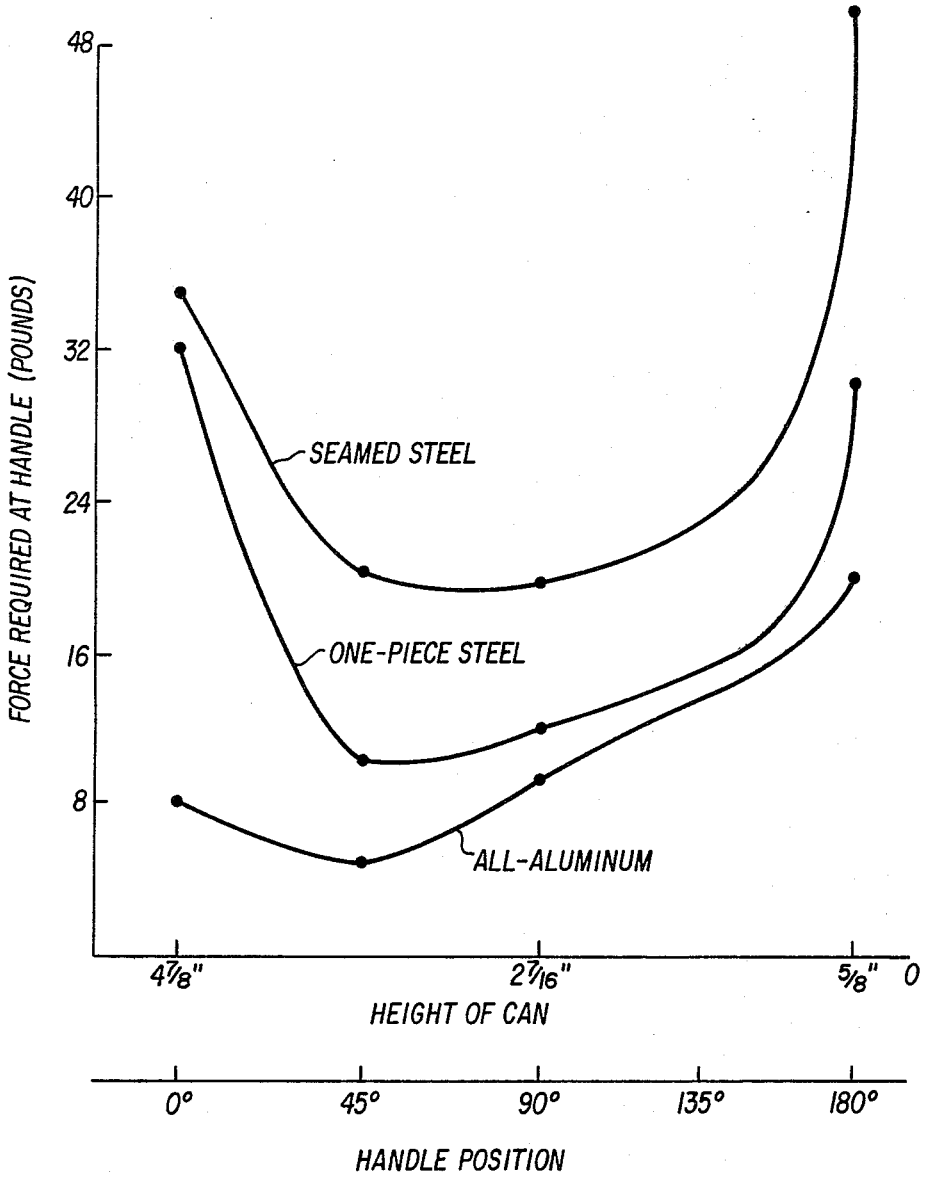
FIG. 7 illustrates the power curve of the present invention for various types of objects to be crushed.

FIG. 7 serves to illustrate the force required to crush beverage cans with the can crusher of the present invention as it relates to the height of the can being crushed and the handle position.

Figure 8A:
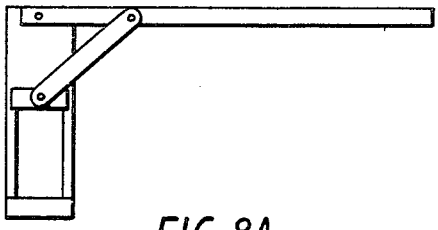
FIG. 8A PRIOR ART
FIGS. 8A–8C shows the design, force diagram and power curve, respectively, of a conventional can crusher.
Figure 8B:
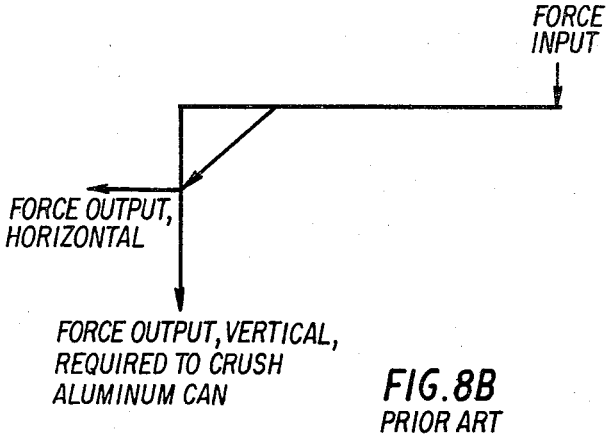
FIG. 8B PRIOR ART
Figure 8C:
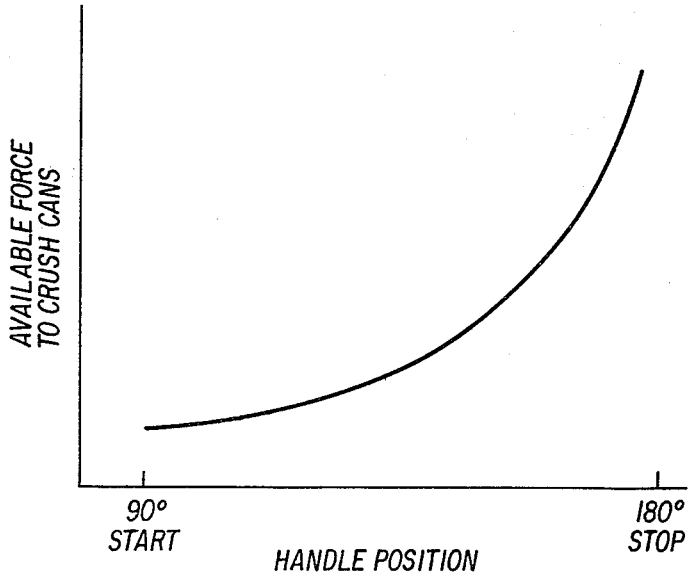
FIG. 8C PRIOR ART

FIGS. 8A–8C show the design, force diagram and power curve of a conventional can crusher. Such a conventional can crusher is typified by U.S. Pat. No. 4,062,283 to Kaminski. More particularly, FIG. 8A serves to illustrate the relationship of the handle, link member and presser member wherein the force input necessary for crushing an all aluminum can was determined to be 52.5 lbs., the force input for crushing a one piece steel can was found to be 83.7 lbs. and the force input to crush seamed steel cans was found to be 161.2 lbs. FIG. 8B serves to illustrate the corresponding force input and resulting force vectors in operation of such device while FIG. 8C discloses the power curve with a constant force input of the Kaminski patent. It can thus be appreciated that the design of Kaminski provides for minimum force multiplication at the starting point of crushing a beverage can and maximum multiplication at its completion whereas the structural strength of the beverage can is greatest at the start of crushing such that maximum force multiplication should rather occur at the start of crushing as in the case of the present invention. The design of Kaminski's linkage produces a horizontal rearward force approximately equal to the vertical downward force (see FIG. 8C) that must be absorbed in the structure of the device itself. It can thus be appreciated that the present invention provides a maximum force at the start of crushing as well as at the completion of crushing.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the Unites States is:

1. A can crusher assembly comprising:

a base including a first and second shelf portion extending from said base;

at least one guide rod interconnecting said upper and lower shelf portions;

a presser member slidably mounted on said at least one guide rod for movement between a first open position for receiving an object to be crushed and a second compression position;

a pin member connected to said presser member;

a handle member;

a pivot member pivotably connecting said handle member to said first shelf portion; and a link member pivotably interconnecting said handle member and said pin member, said link member being interconnected to said handle member in said open position above said pivot member wherein said pivot member, said at least one guide rod, said handle member and said pin member are disposed in substantially the same plane in said open position for maximizing the crushing force applied to said object to be crushed positioned between said presser member and said at least one of said first and second shelf portions.

2. The crusher assembly as set forth in claim 1, said at least one guide rod comprising first and second parallel guide rods.

3. The crusher assembly as set forth in claim 1 or 2, further comprising means for biasing said presser member into said open position.

4. The crusher assembly as set forth in claims 1 or 2, further comprising means for ejecting said object mounted on said at least one of said first and second shelf portions.

5. The crusher assembly as set forth in claim 1, wherein said handle member is pivotable through an angle of approximately 120° with respect to said base.

6. The crusher assembly as set forth in claims 1 or 5, said at least one of said first and second shelf portions comprising means for symmetrically positioning said object to be crushed substantially in said plane within which said pivot member, said at least one of said first and second shelf portions, said handle member and said pin member are disposed in said open position.

7. The crusher assembly as set forth in claim 1, further comprising a flap member interconnecting said handle member and said presser member for limiting splashing of fluid contained within said object to be crushed.

8. The crusher assembly as set forth in claim 1, wherein said at least one of said first and second shelf portions comprises a lower shelf portion.

9. The crusher assembly as set forth in claim 2, wherein said presser member is symmetrically positioned between said first and second guide rods and within said plane within which said pivot member, said at least one of said first and second shelf portions, said handle member and said pin member are disposed in said open position.

* * * * *